US006536531B2

(12) United States Patent
Brunet

(10) Patent No.: US 6,536,531 B2
(45) Date of Patent: Mar. 25, 2003

(54) APPARATUS AND METHODS FOR ORIENTATION OF A TUBULAR STRING IN A NON-VERTICAL WELLBORE

(75) Inventor: Charles G. Brunet, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/901,232

(22) Filed: Jul. 9, 2001

(65) Prior Publication Data

US 2002/0003040 A1 Jan. 10, 2002

Related U.S. Application Data

(60) Provisional application No. 60/216,942, filed on Jul. 10, 2000.

(51) Int. Cl.[7] ..... E21B 47/00

(52) U.S. Cl. ..... 166/380; 166/50; 166/117.5

(58) Field of Search ..... 166/380, 50, 117.5, 166/246.6, 242.8, 55.1, 55.2

(56) References Cited

U.S. PATENT DOCUMENTS 6,003,621 A * 12/1999 Murray ..... 175/79

* cited by examiner

*Primary Examiner*—William Neuder
(74) *Attorney, Agent, or Firm*—Moser, Patterson & Sheridan, L.L.P.

(57) ABSTRACT

An apparatus and method for orienting tubular strings in wellbores. In one aspect, the invention utilizes the inherent eccentricity of a non-vertical wellbore to provide a means of orienting a portion of casing that contains a pre-milled window.

30 Claims, 5 Drawing Sheets

APPARATUS AND METHODS FOR ORIENTATION OF A TUBULAR STRING IN A NON-VERTICAL WELLBORE

RELATED APPLICATIONS

This application claims priority to U.S. Provisional Application Ser. No. 60/216,942 filed Jul. 10, 2000 which is incorporated herein in its entirety.

BACKGROUND OF THE INVENTION

1. Field of the Invention

The present invention relates generally to an apparatus and methods for orienting tubulars in wellbores. More specifically, the invention relates to an apparatus and method for rotationally orienting an opening or window in a casing or tubular string in a non-vertical wellbore. More specifically still, the invention relates to an apparatus and methods whereby the shape of the apparatus, as well as the relationship between the center of gravity and the geometric center of the apparatus, is used to rotationally orient the casing or tubular string in a non-vertical wellbore.

2. Description of the Related Art

Lateral wellbores are routinely used to more effectively and efficiently access hydrocarbon-bearing formations. They are typically formed from a central wellbore. In one conventional method, a window is formed in casing after the casing is located in the central wellbore. In some instances, the window is formed in the wellbore with a milling tool prior to the formation of the lateral wellbore. In other instances, the casings inserted into the central wellbores contain pre-milled windows to allow the lateral wellbore to be formed without the prior steps of forming a casing window. Because lateral wellbores "kicked off" from central wellbores are so popular, they are sometimes formed from central wellbores that are themselves non-vertical and are in some cases horizontal. When utilizing a pre-milled window, it is necessary to provide a means of ensuring the section of the casing containing the pre-milled window is in the desired rotational orientation after being axially positioned in the central wellbore. Rotational orientation ensures that the lateral wellbore will be directed towards the desired formation.

A conventional method of ensuring the correct rotational orientation of the casing is to use a survey tool, which is well known in the art, to detect the actual window orientation. Once the actual orientation is known, the entire casing is rotated from the surface of the drilling rig, until the survey tool detects the window is in the desired orientation.

The casing string above the window may be several thousand feet long, and therefore rotation of the entire casing places significant torsional stresses on the casing. The survey tool is typically run into the well on a wireline in a separate run. The equipment is expensive, not always accurate and its use requires valuable rig time. The inherent weakening of the casing in the section where the pre-milled window is located further aggravates the problems associated with high torsional stresses. The combination of high torsional stresses and weakness in the casing near the window can lead to failures of the casing, resulting in significant delays and additional expense.

An alternative method of ensuring the correct rotational orientation of a casing window utilizes an apparatus that de-couples a lower section of the casing from an upper section when the casing is placed in tension. The apparatus and method which allow the independent rotational movement of the two sections of casing are disclosed in U.S. Pat. No. 6,199,635, issued on Mar. 13, 2001 to the inventor of the present invention. That patent is incorporated by reference herein in its entirety. In this method, a survey tool is used to detect the rotational orientation of the casing window. The casing is then placed in tension by using a drill string to lift up on the casing at the surface, thereby de-coupling a section of the casing (including the section with the pre-milled window) downhole of the device from the remaining portion of the casing. A drill string can then be used to rotate the section of the casing containing the pre-milled window independent of the upper portion of the casing. Because a pre-milled window is usually near the end of the casing, this method has the advantage of eliminating the need to rotate a majority of the casing, thereby reducing torsional stresses on the casing and the chance for a casing failure. However, this method requires the use of a survey tool and a separate run into the well, thereby increasing the time and costs.

When installing casing in a non-vertical wellbore, it is also necessary to provide a means for offsetting the natural tendency of the casing to rest against the bottom or "low side" of the wellbore. This is needed to ensure that cement, which fills the annular area between the outside of the casing and the wellbore, completely surrounds the circumference of the casing and provides a good bond between the casing and the walls of the wellbore.

This need is typically met through the use of centralizers, which are devices placed around the outside of the casing. These devices support the casing in the center of the wellbore so that it is not resting on the bottom of the non-vertical wellbore. Conventional centralizers do not, however, impart any rotational forces on the casing.

When installing casing with a pre-milled window in a wellbore, it is further necessary to provide a means of temporarily covering the pre-milled window in the casing in order to allow cement to be pumped through the end of the casing and into the annular area between the casing and the wellbore.

The need to cover the window is typically met through the use of a temporary inner liner within the casing. The inner liner does not contain a window (as the casing does), and therefore allows cement to be pumped through the section of casing having the window and into the annular area between the casing and the wellbore. After the cement has been pumped through the inner liner, the liner is removed or destroyed by drilling and the window in the casing is exposed. The inner liner is typically fiberglass or a similar drillable material and does not provide any increased structural rigidity to the weakened section of the casing containing the pre-milled window during the casing installation process.

Typically, casing is run with a float shoe at a lower end thereof. The float shoe facilitates cementing and prevents the backflow of cement into the casing or tubular string. This is accomplished through the use of a check valve incorporated into the float shoe. Conventional float shoes, like centralizers, do not impart any rotational forces on the casing.

There is a need therefore, for an apparatus and method to rotationally orient a tubular string in a non-vertical wellbore that will overcome the shortcomings of the prior art devices and methods. There is a further need for an apparatus and method to rotationally orient a tubular string having a pre-milled window in a non-vertical wellbore without placing significant torsional stresses on the tubular string in the area of the window. There is still a further need for an apparatus and method to rotationally orient a tubular string in a non-vertical wellbore without the expense of survey tools or extra additional trips into the well.

There is a further need for an apparatus and method which will both centralize a casing or tubular string within a non-vertical wellbore and impart rotational forces to the casing or tubular string so that it may be placed in a desired rotational orientation.

There is yet a further need for an apparatus and method which will both temporarily cover a pre-milled window in a casing and provide increased structural rigidity to the weakened section of the casing containing the pre-milled window during the casing installation process.

There is a further need for an apparatus and method which will temporarily cover a pre-milled window in a casing, and serve as a pressure barrier to contain any cement which is pumped through the casing section containing the pre-milled window during the casing installation process.

There is yet a further need for an apparatus and method which will provide increased structural rigidity to the weakened section of the casing containing the pre-milled window during the casing installation process.

There is a further need for an apparatus and method which will both prevent the back flow of cement into the tubular string or casing and will impart rotational forces to the tubular string or casing so that it may be placed in a desired rotational orientation.

SUMMARY OF THE INVENTION

The present invention relates generally to an apparatus and method for orienting tubular strings in wellbores. One embodiment of the invention utilizes the inherent eccentricity of a non-vertical wellbore to provide a means of orienting a portion of casing that contains a pre-milled window.

Any device such as a float shoe, outer sleeve, or centralizer that is mechanically attached to the casing near a pre-milled window may incorporate the present invention. The device is manufactured to include an eccentric portion that generally matches the cross-sectional profile of directional wellbore. Either or both the conforming shape and the gravitational effects on the eccentric portion combine to rotationally orient the device and casing to the wellbore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 1:
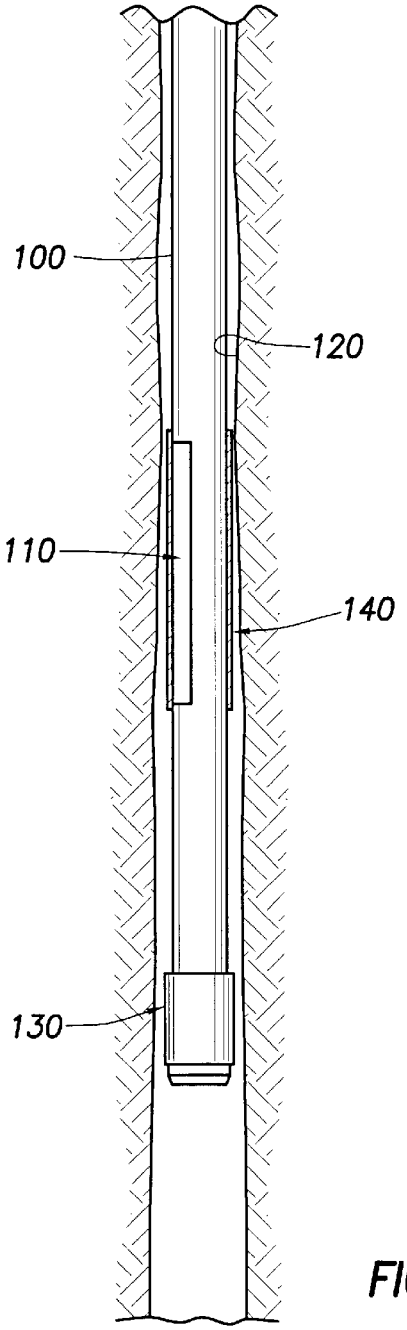
FIG. 1 is a section view of a vertical wellbore with a casing having a pre-milled window, an orienting outer sleeve, and an orienting float shoe.

FIG. 1 is a section view of a casing 100 with a pre-milled window 110 formed in a wall thereof, an orienting outer sleeve 140, and an orienting float shoe 130 in a run-in position in a vertical wellbore 120. The wellbore is initially formed as a borehole in the earth and the casing is run into the borehole to line the sides thereof and form a wellbore.

Figure 2:
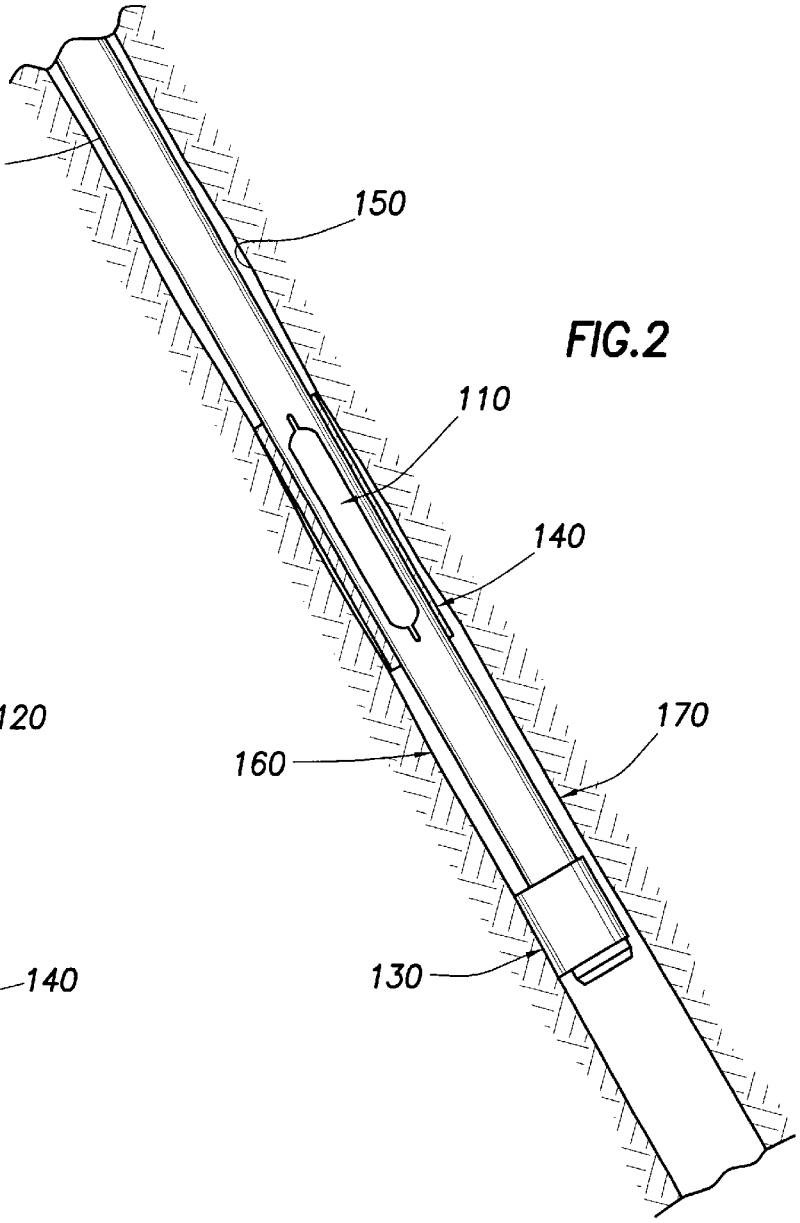
FIG. 2 is a section view of the casing of FIG. 1 in a non-vertical wellbore.

FIG. 2 is a section view of a casing 100 with a pre-milled window 110, an orienting outer sleeve 140, and an orienting float shoe 130. The casing 100, orienting outer sleeve 140, and float shoe 130 are illustrated in a non-vertical wellbore 150 with a low side of 160 and a high side of 170. Typically, a non-vertical wellbore is one at an angle of at least 15° from the vertical.

Figure 3A:
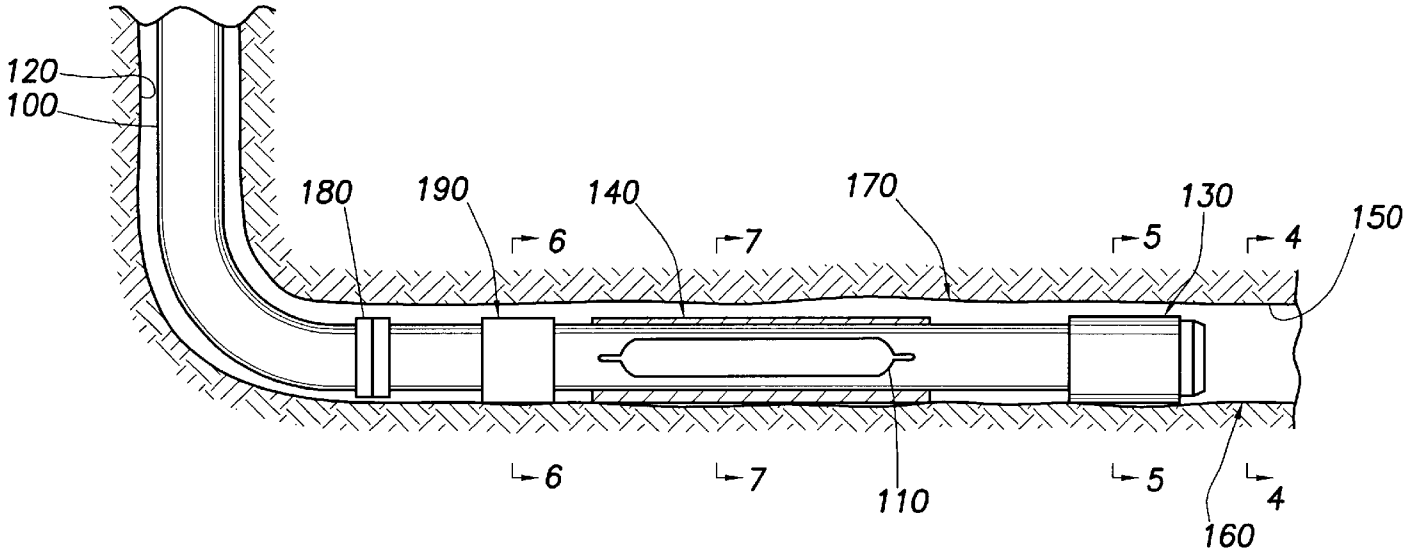
FIG. 3A is a section view of a casing with a pre-milled window, an orienting float shoe, an orienting outer sleeve, an orienting centralizer and a swivel in a non-vertical wellbore.
Figure 3B:
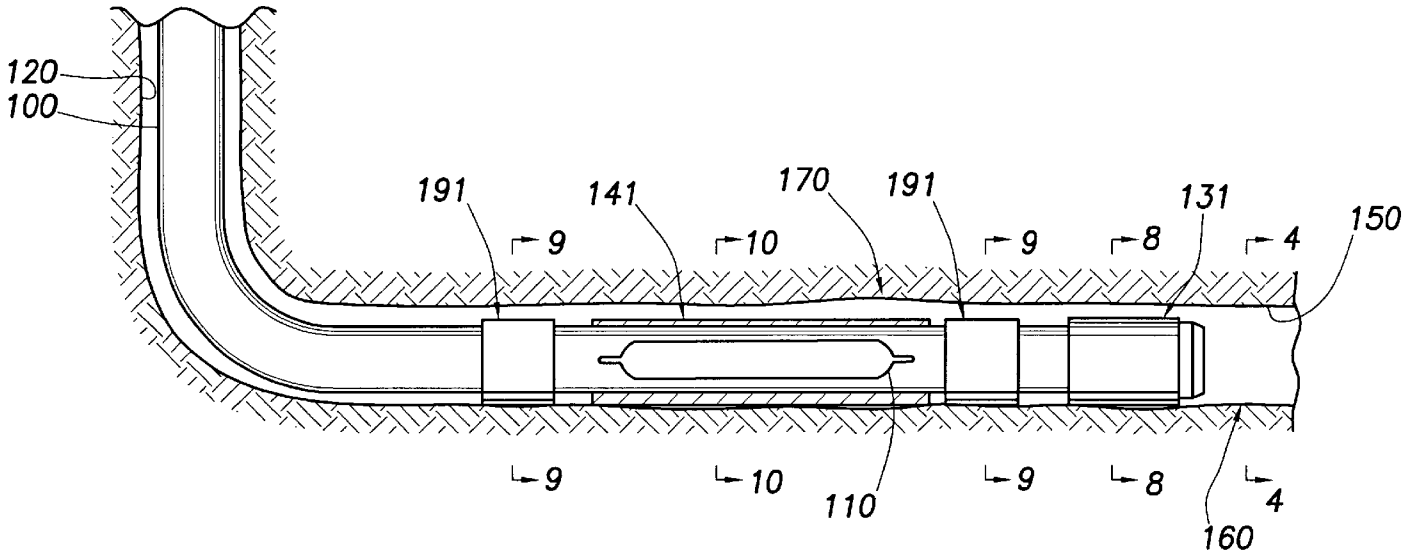
FIG. 3B is a section view of a casing with a pre-milled window, an orienting float shoe, an orienting outer sleeve, and two orienting centralizers in a non-vertical wellbore.

FIG. 3A is a section view of a vertical wellbore 120 transitioning into a non-vertical wellbore 150 having a high side 170 and a low side 160. Casing 100 with a pre-milled window 110 is illustrated in the non-vertical wellbore 150. In addition, an orienting centralizer 190 has been added to the orienting outer sleeve 140 and the orienting float shoe 130. FIG. 3B is a section view of a casing 100 with a pre-milled window 110, an orienting float shoe 131, an orienting outer sleeve 141, and two orienting centralizers 191, in a non-vertical wellbore. The centralizers 191 are disposed at each end of the window. In the embodiment shown in FIG. 3B, there is no swivel device disposed in the casing string. Without the use of a swivel device, the casing 100 must be allowed to rotate freely at the surface as the casing 100 is lowered into the vertical wellbore 120 and eventually inserted into the non-vertical wellbore 150.

Figure 4:
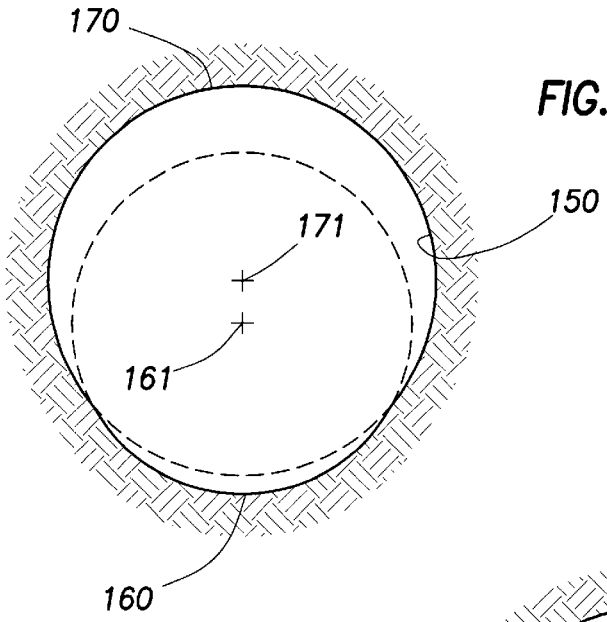
FIG. 4 is a section view of the non-vertical wellbore taken along a line 4—4.

FIG. 4 is a section view of the non-vertical wellbore 150 of FIGS. 3A and 3B taken along a line 4—4. As shown in FIG. 4, the cross-section of the non-vertical wellbore 150 is not a perfect circle. The "low side" 160 of the non-vertical wellbore 150 is a segment of a circle whose center 161 is below the center 171 of the circle segment formed by the "high side" 170 of non-vertical wellbore 150. The gravitational effects on tools moving in and out of the non-vertical wellbore cause this eccentricity in its shape. For example, as a drilling tool is repeatedly inserted into and retracted from the non-vertical wellbore 150, the tool is always in contact with the low side 160 of the non-vertical wellbore 150. This causes more material to be removed from the low side 160 than the high side 170, resulting in an eccentric segment of a circle (a crescent shape) being formed at the bottom of non-vertical wellbore 150.

The present invention utilizes the eccentricity of non-vertical wellbore 150 as shown in FIG. 4 to provide a means of orienting that portion of the casing 100 that contains the pre-milled window 110. This is accomplished by incorporating an eccentric shape into a device that is attached to the casing 100 at or near the pre-milled window 110. The eccentric shape will conform to the shape portrayed in FIG. 4, and can be incorporated into an orienting centralizer 190, an orienting outer sleeve 140, or an orienting float shoe 130, as shown in FIG. 3A. Any combination of an orienting centralizer 190, outer sleeve 140, and/or float shoe 130 may be used, as well as multiple orienting centralizers 190. In practice, the eccentric shape can be formed anywhere on a tubular or formed on the tubular itself and the possibilities are limited only by the needs of an operator. In addition, as illustrated in FIG. 3A, a swivel 180 can be used to reduce the portion of the casing string that must rotate in order to place the pre-milled window 110 in the desired orientation in the wellbore. The swivel 180 allows the portion of the casing string downhole of the swivel 180 to rotate independent of that portion of the casing string uphole of the swivel 180.

Figure 5:
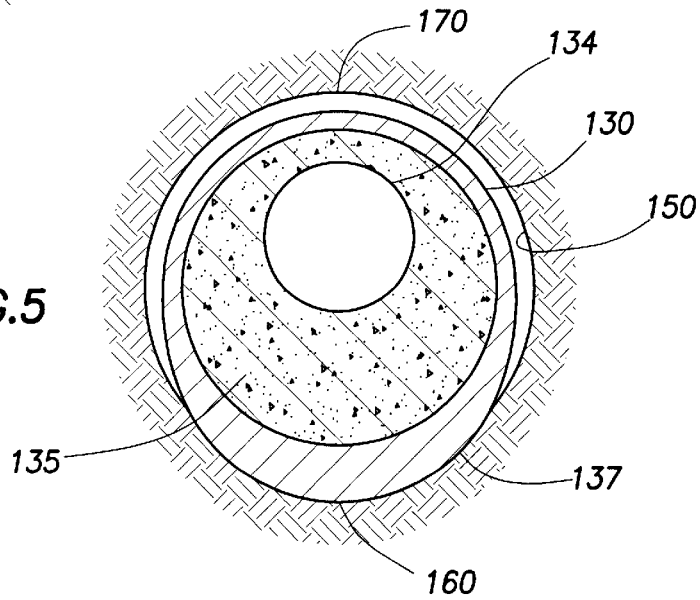
FIG. 5 is a section view of an orienting float shoe installed on casing inserted into a non-vertical wellbore taken along a line 5—5.

FIG. 5 is a section view of an orienting float shoe 130 installed on casing 100 in a non-vertical wellbore 150 having a low side 160 and a high side 170 taken along a line 5—5 of FIG. 3A. Like a conventional float shoe, the orienting float shoe 130 contains a bore 134 to allow cement (not shown) to flow through the float shoe 130 and fill an area between the outside of the casing 100 and the non-vertical wellbore 150 and the vertical wellbore 120. A check valve (not shown) in float shoe 130 prevents cement from flowing back through the float shoe 130 and into the casing 100.

In addition, an eccentric portion 137 of orienting float shoe 130 is visible in FIG. 5. This eccentric portion 137 engages the low side 160 of the non-vertical wellbore 150 to provide a known rotational orientation between the float shoe 130 and the wellbore 50. In one embodiment, the float shoe 130 is filled with cement 135 or another drillable material of high specific gravity before being inserted into vertical wellbore 120 and non-vertical wellbore 150. The cement 135 is used to support a tubular member (not shown) that forms the bore 134. Due to the void caused by the bore 134, the center of gravity of the orienting shoe 130 is lower than the geometric center. The gravitational effect on this configuration, in addition to the engagement of eccentric portion 137 in the low side 160 of non-vertical wellbore 150, imparts rotational forces on the orienting float shoe 130 and helps to provide a known rotational orientation between the float shoe 130 and the non-vertical wellbore 150. The orienting float shoe 130 is attached to the casing 100 by a threaded connection, locking pins, welding or other suitable mechanical means so that the pre-milled window 110 will be in the desired rotational orientation when the eccentric portion 137 is engaged with the low side 160 of the non-vertical wellbore 150.

Figure 6:
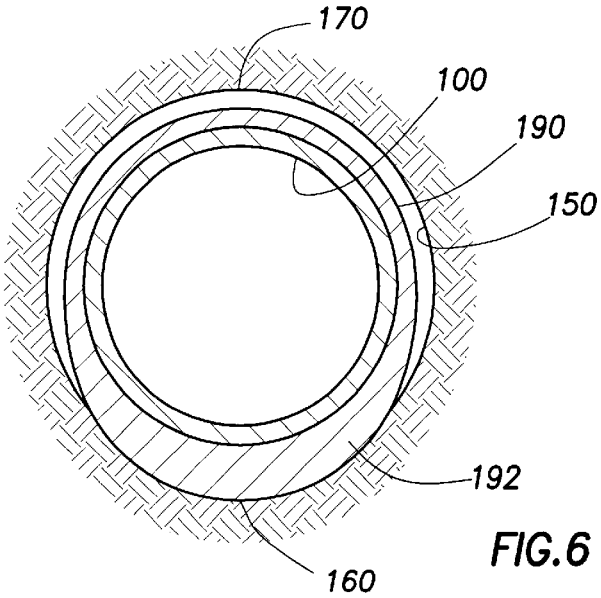
FIG. 6 is a section view of an orienting centralizer installed on casing in a non-vertical wellbore taken along a line 6—6.

FIG. 6 is a section view of an orienting centralizer 190 installed on casing 100 in a non-vertical wellbore 150 with a low side 160 and a high side 170 taken along a line 6—6 of FIG. 3A. As shown in FIG. 6, the lower portion of the orienting centralizer 190 contains an eccentric portion 192 shaped to conform to the low side 160 of the non-vertical wellbore 150. The eccentric portion 192 shown at the bottom of the orienting centralizer 190 in cross-section in FIG. 6, engages a corresponding eccentric shape formed in the low side 160 of non-vertical wellbore 150. In this manner, the casing is rotationally oriented within the non-vertical wellbore. Because the pre-milled window is a known angular distance from the eccentric shape, the window can be rotationally oriented for the formation of another non-vertical wellbore from the window.

In addition to the engagement of the eccentric shapes, there is another factor which may assist the orienting centralizer 190 to align in a predetermined and repeatable manner with respect to a non-vertical wellbore. The gravitational effect on the additional mass of the eccentric portion of the orienting centralizer 190 causes the eccentric portion to rotate to the lowest point, and thereby align with the low side 160 of the non-vertical wellbore 150. The orienting centralizer 190 is typically attached to the casing 100 by a threaded connection, locking pins, welding or other suitable mechanical means so that the pre-milled window 110 will be in the desired rotational orientation when the eccentric portion 192 is engaged with the low side 160 of the non-vertical wellbore 150.

Figure 7:
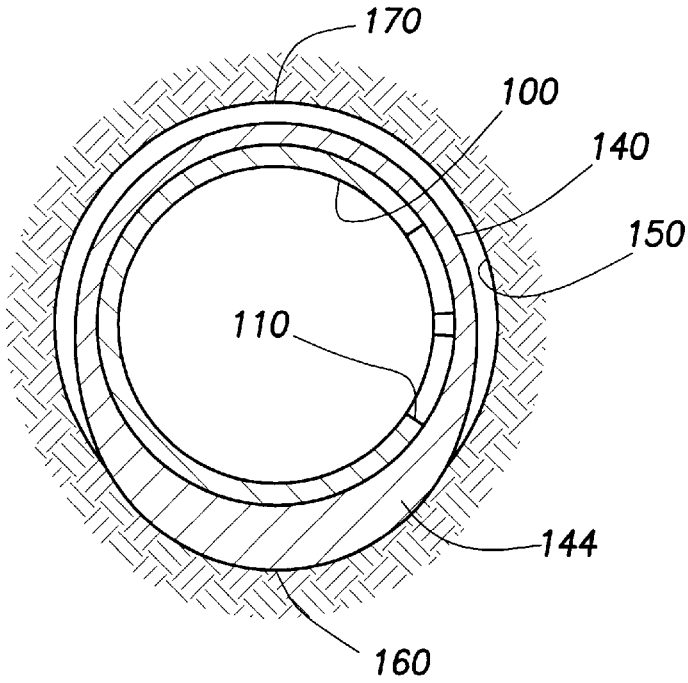
FIG. 7 is section view of an orienting outer sleeve installed on casing in a non-vertical wellbore taken along a line 7—7.

FIG. 7 is section view of an orienting outer sleeve 140 installed on casing 100 in a non-vertical wellbore 150 with a low side 160 and a high side 170 taken along a line 7—7 of FIG. 3A. The orienting sleeve contains an eccentric portion 144 that engages in the low side 160 of non-vertical wellbore 150. As previously discussed regarding the orienting float shoe 130 and the orienting centralizer 190, both the shape of eccentric portion 144 and the gravitational effects on eccentric portion 144 can combine to align eccentric portion 144 with the low side 160 of wellbore 150. In addition to the rotational alignment purposes, orienting outer sleeve 140 covers the pre-milled window 110, allowing cement (not shown) to subsequently be pumped through the casing 100 and into the area between the casing 100 and both the non-vertical wellbore 150 and the vertical wellbore 120.

The orienting outer sleeve 140 is also mechanically attached to the casing 100, so that the pre-milled window 110 will be in the desired rotational orientation when the eccentric portion 144 is engaged with the low side 160 of the non-vertical wellbore 150.

Because orienting outer sleeve 140 will eventually be removed to expose the area of pre-milled window 110, it is necessary to manufacture orienting outer sleeve 140 from aluminum or a similar easily machined material. Therefore, orienting outer sleeve 140 can not be welded to the casing 100, which is typically made of steel. A means of attaching a concentric outer sleeve to cover a pre-milled window is disclosed in U.S. Pat. No. 6,041,855, issued on Mar. 28, 2000 to Nistor, and that patent is incorporated herein by reference in its entirety. By incorporating the means of attachment disclosed in the '855 patent to the eccentric outer sleeve 140, an additional benefit of increased structural rigidity in the area of the casing 100 containing the pre-milled window 110 will be realized. This increase in strength will reduce the likelihood of a casing 100 failure in the area weakened by the removal of material to form the pre-milled window 110, especially during the process of installing and aligning the casing 100 into the vertical wellbore 120 and the horizontal wellbore 150.

Figure 8:
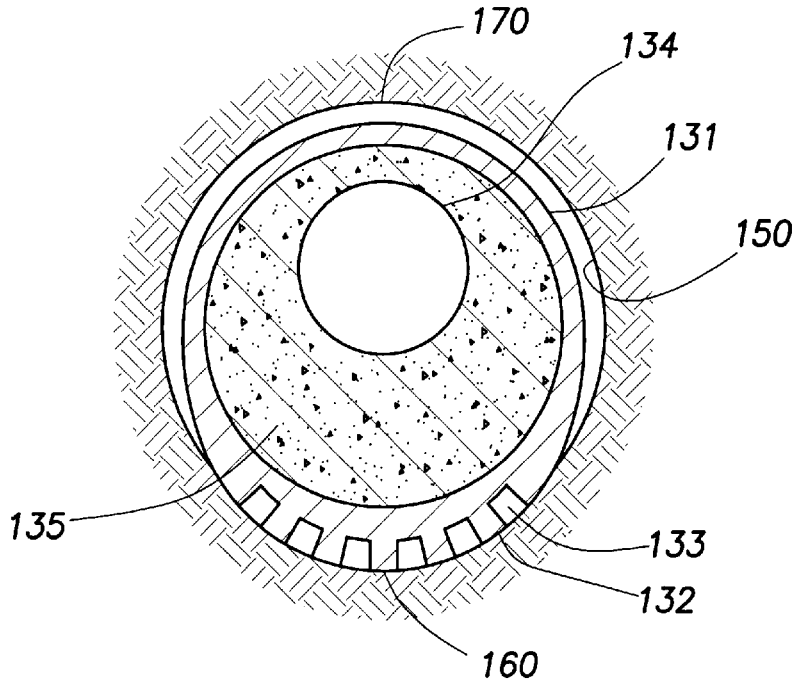
FIG. 8 is a section view of an alternative embodiment of an orienting float shoe installed on casing inserted into a non-vertical wellbore taken along a line 8—8.

FIG. 8 is a section view of an alternative embodiment of an orienting float shoe 131 installed on casing 100 inserted into a non-vertical wellbore 150 with a low side of 160 and a high side of 170 taken along a line 8—8. The orienting float shoe 131 contains a bore 134 to allow cement (not shown) to flow through the float shoe 131 and fill the area between the outside of the casing 100 and the non-vertical wellbore 150 and the vertical wellbore 120. A check valve (not shown) in float shoe 131 prevents cement from flowing back through the float shoe 131 and into the casing 100. Additionally, the float shoe 130 is filled with cement 135 or another drillable material of high specific gravity before being inserted into vertical wellbore 120 and non-vertical wellbore 150. The cement 135 is used to support a tubular member (not shown) that forms the bore 134.

The alternate embodiment depicted in FIG. 8 includes eccentric ribs 132 that engage into the low side 160 of the wellbore 150. The eccentric ribs 132 orient the float shoe 131, and therefore the casing 100 to which it is attached, in the manner previously described in the discussion of FIG. 5. The grooves 133 between the eccentric ribs 132 allow cement (not shown) to flow underneath the orienting float shoe 131, thereby improving the bonding between the cement and the outside of the casing 100 and the non-vertical wellbore 150.

Figure 9:
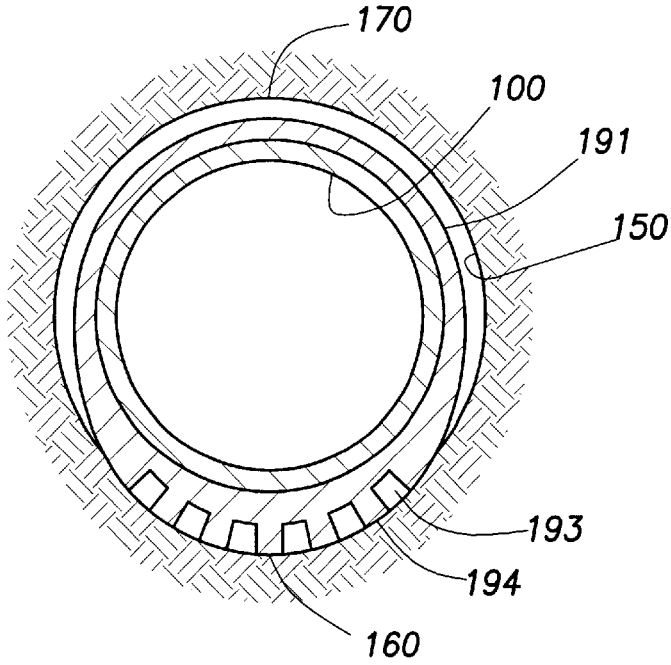
FIG. 9 is a section view of an alternative embodiment of an orienting centralizer installed on casing inserted into a non-vertical wellbore taken along a line 9—9.

FIG. 9 is a section view of an alternative embodiment of an orienting centralizer 191 installed on casing 100 inserted into a non-vertical wellbore 150 with a low side 160 and a high side 170 taken along a line 9—9. As shown in FIG. 9, the lower portion of the orienting centralizer 191 contains eccentric ribs 194 shaped to conform to the low side 160 of the non-vertical wellbore 150.

The eccentric ribs 194 shown at the bottom of the orienting centralizer 191 in cross-section in FIG. 9 engage the corresponding eccentric shape formed in the low side 160 of non-vertical wellbore 150. The eccentric ribs 194 orient the centralizer 191, and therefore the casing 100 to which it is attached, in the manner previously described in the discussion of FIG. 6. The grooves 193 between the eccentric ribs 194 allow cement (not shown) to flow underneath the orienting centralizer 191, thereby improving the bonding between the cement and the outside of the casing 100 and the non-vertical wellbore 150.

Figure 10:
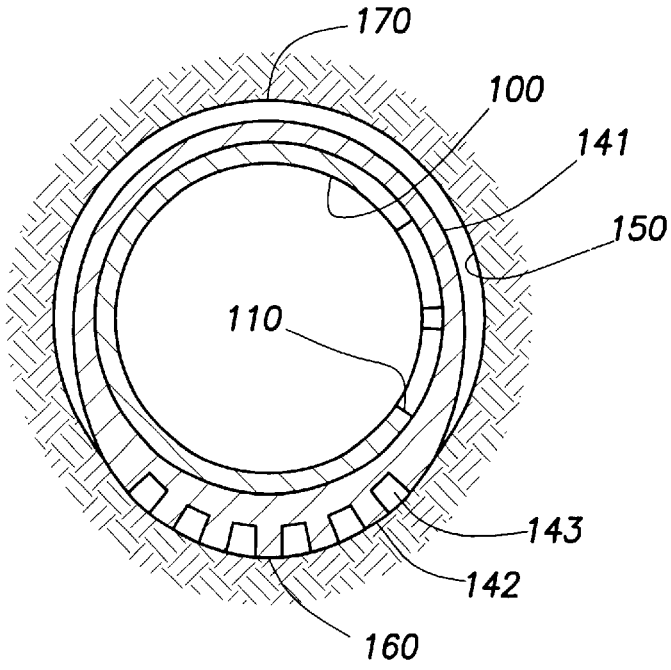
FIG. 10 is section view of an alternative embodiment of an orienting outer sleeve installed on casing inserted into a non-vertical wellbore taken along a line 10—10.

FIG. 10 is section view of an alternative embodiment of an orienting outer sleeve 141 installed on casing 100 inserted into a non-vertical wellbore 150 with a low side 160 and a high side 170 taken along a line 10—10. The orienting sleeve contains eccentric ribs 142 that engage in the low side 160 of non-vertical wellbore 150. The eccentric ribs 142 orient the outer sleeve 141, and therefore the casing 100 to which it is attached, in the manner previously described in the discussion of FIG. 7. The grooves 143 between the eccentric ribs 142 allow cement (not shown) to flow underneath the orienting outer sleeve 141, thereby improving the bonding between the cement and the outside of the casing 100 and the non-vertical wellbore 150.

The orienting sleeve shown in FIG. 10 and other Figures performs three functions. First, it provides an eccentric shape adding mass, weight and profile to the casing at a certain location, thereby ensuring the casing will orient itself rotationally in the wellbore. Second, the sleeve acts to provide strength to the casing which would otherwise be compromised due to the window formed in the wall thereof. Finally, the sleeve acts to temporarily block the window and permit the casing to pass fluids, like cement prior to the formation of a lateral borehole through the window.

In use, the apparatus of the present invention may be implemented as follows. A string of tubulars is assembled at the surface to form the casing of a central wellbore. An eccentric orienting device is disposed on the casing, proximate a segment of the casing containing a pre-milled window. The segment of the casing containing the eccentric orienting device and the window is allowed to rotate freely so that the eccentric portion of the device may engage in the corresponding eccentric portion at the bottom of the wellbore. The eccentric orienting device is disposed on the casing so that engagement of the eccentric shapes will place the pre-milled window in the correct orientation. After the pre-milled window is placed at the desired depth in the wellbore, the string of tubulars is cemented into the wellbore, using devices well known in the art. Another wellbore may then be formed at the desired depth and orientation by exiting the primary wellbore through the pre-milled window.

While the foregoing is directed to embodiments of the present invention, other and further embodiments of the invention may be devised without departing from the basic scope thereof, and the scope thereof is determined by the claims that follow.

What is claimed is:

1. An orienting apparatus for a tubular comprising:

a tubular member with a window formed in a wall thereof, the window constructed and arranged to permit the formation of a new wellbore utilizing the window as an exit path for a drill; and at least one orienting member disposed on the tubular, the orienting member having an eccentric portion constructed and arranged to cause a side of the tubular with the orienting member to assume a lower position and to rotationally orient the tubular in a non-vertical wellbore housing the tubular.

2. The orienting apparatus of claim 1, wherein the at least one orienting member is located proximate the window.

3. The orienting apparatus of claim 2, wherein the at least one orienting member is an orienting sleeve disposed around the tubular and substantially covering the widow.

4. The orienting apparatus of claim 2, wherein the at least one orienting member is a centralizer having an eccentric portion formed thereupon.

5. The orienting apparatus of claim 2, wherein the at least one orienting member is a float shoe having an eccentric portion formed thereupon.

6. The orienting apparatus of claim 2, wherein the tubular is a string of tubulars and a swivel is disposed on the string of tubulars proximate the tubular having the window, the swivel permitting the tubular having the window to rotate independently of the other tubulars in the string.

7. The orienting apparatus of claim 6, wherein the swivel is a selectively activated swivel permitting the tubular to rotate in a first instance and to be fixed to the other tubulars in a second instance.

8. The orienting apparatus of claim 2, wherein the at least one orienting member includes two centralizers, the window disposed between the centralizers.

9. The orienting apparatus of claim 2, wherein the at least one orienting member includes two centralizers and a float shoe.

10. The orienting apparatus of claim 2, wherein the eccentric portion includes a gradually increasing and decreasing shape, the shape having a generally crescent shape in cross section.

11. The orienting apparatus of claim 2, wherein the eccentric portion includes a plurality of radially outward extending members with spaces formed therebetween, the outer surface of the members forming an outer surface of the eccentric portion.

12. The orienting apparatus of claim 2, wherein the eccentric portion includes an increased mass causing the side of the tubular with the eccentric portion formed thereupon to rotate to the lowest point in the non-vertical wellbore, thereby orienting the window at a predetermined angular location in the wellbore.

13. The orienting apparatus of claim 3, wherein the orienting sleeve is affixed to the exterior of the tubular in a manner permitting the sleeve to bear tortional stresses placed upon the tubular.

14. The orienting apparatus of claim 3, wherein the orienting sleeve is designed to initially prevent fluid communication between an interior and exterior of the tubular and then to be removed to permit access to the earth by a drill.

15. The orienting apparatus of claim 2, wherein an outer surface of the eccentric portion is constructed and arranged to substantially match an eccentric profile formed in the low side of the non-vertical wellbore.

16. A method of using an orienting device in a wellbore, comprising:

assembling a string of tubulars, the string having a tubular member including a preformed window formed therein and an orienting member disposed proximate the window;

running the string of tubulars into the wellbore to a location within a non-vertical portion of the wellbore; and permitting the string to be rotationally free during at least a later portion of the run in operation, whereby an eccentric portion of the orienting member rotationally orients the string as the eccentric portion assumes a position within a lower portion of the non-vertical wellbore.

17. An orienting apparatus for a tubular, comprising:

at least one orienting member for disposal proximate a window in a tubular, the orienting member having an eccentric portion constructed and arranged to cause a side of the tubular having the orienting member thereupon to assume a lower position and rotationally orient the tubular in a non-vertical wellbore when the tubular is run into a well.

18. The orienting apparatus of claim 17, wherein the eccentric portion includes an enlarged formation resulting in an increased radius of the tubular in a location of the eccentric member.

19. The orienting apparatus of claim 18, wherein the orienting member is formed on a centralizer.

20. The orienting apparatus of claim 18, wherein the orienting member is formed on a float shoe.

21. The orienting apparatus of claim 18, wherein the orienting member is formed on a sleeve for temporarily covering the window of the tubular.

22. The orienting apparatus of claim 17, wherein the eccentric portion operates to shift the gravitational center of the tubular from the center of the tubular.

23. An orienting apparatus for a tubular comprising:

a tubular member with a window formed in a wall thereof, the window constructed and arranged to permit the formation of a new wellbore utilizing the window as an exit path for a drill; and at least one orienting member disposed on the tubular, the orienting member having an eccentric portion constructed and arranged to cause a side of the tubular with the orienting member to assume a lower position in a non-vertical wellbore housing the tubular, wherein the at least one orienting member is located proximate the window and the at least one orienting member is an orienting sleeve disposed around the tubular and substantially covering the window.

24. The orienting apparatus of claim 23, wherein the orienting sleeve is affixed to the exterior of the tubular in a manner permitting the sleeve to bear tortional stresses placed upon the tubular.

25. The orienting apparatus of claim 23, wherein the orienting sleeve is designed to initially prevent fluid communication between an interior and exterior of the tubular and then to be removed to permit access to the earth by a drill.

26. An orienting apparatus for a tubular comprising:

a tubular member with a window formed in a wall thereof, the window constructed and arranged to permit the formation of a new wellbore utilizing the window as an exit path for a drill; and at least one orienting member disposed on the tubular, the orienting member having an eccentric portion constructed and arranged to cause a side of the tubular with the orienting member to assume a lower position in a non-vertical wellbore housing the tubular, wherein the at least one orienting member is located proximate the window and the at least one orienting member is a float shoe having an eccentric portion formed thereupon.

27. An orienting apparatus for a tubular comprising:

a tubular member with a window formed in a wall thereof, the window constructed and arranged to permit the formation of a new wellbore utilizing the window as an exit path for a drill; and at least one orienting member disposed on the tubular, the orienting member having an eccentric portion constructed and arranged to cause a side of the tubular with the orienting member to assume a lower position in a non-vertical wellbore housing the tubular, wherein the at least one orienting member is located proximate the window and the at least one orienting member includes two centralizers and a float shoe.

28. An orienting apparatus for a tubular comprising:

a tubular member with a window formed in a wall thereof, the window constructed and arranged to permit the formation of a new wellbore utilizing the window as an exit path for a drill; and at least one orienting member disposed on the tubular, the orienting member having an eccentric portion constructed and arranged to cause a side of the tubular with the orienting member to assume a lower position in a non-vertical wellbore housing the tubular, wherein the at least one orienting member is located proximate the window and the eccentric portion includes a plurality of radially outward extending members with spaces formed therebetween, the outer surface of the members forming an outer surface of the eccentric portion.

29. An orienting apparatus for a tubular, comprising:

at least one orienting member for disposal proximate a window in a tubular, the orienting member having an eccentric portion constructed and arranged to cause a side of the tubular having the orienting member thereupon to assume a lower position in a non-vertical wellbore when the tubular is run into a well, wherein the eccentric portion includes an enlarged formation resulting in an increased radius of the tubular in a location of the eccentric member and the orienting member is formed on a float shoe.

30. An orienting apparatus for a tubular, comprising:

at least one orienting member for disposal proximate a window in a tubular, the orienting member having an eccentric portion constructed and arranged to cause a side of the tubular having the orienting member thereupon to assume a lower position in a non-vertical wellbore when the tubular is run into a well, wherein the eccentric portion includes an enlarged formation resulting in an increased radius of the tubular in a location of the eccentric member and the orienting member is formed on a sleeve for temporarily covering the window of the tubular.

* * * * *